US012480697B2

(12) United States Patent
Ryu et al.

(10) Patent No.: US 12,480,697 B2
(45) Date of Patent: Nov. 25, 2025

(54) ICE MAKER APPLIANCE CONTROL METHODS

(71) Applicant: Haier US Appliance Solutions, Inc., Wilmington, DE (US)

(72) Inventors: Choon Jae Ryu, Prospect, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 184 days.

(21) Appl. No.: 18/183,692

(22) Filed: Mar. 14, 2023

(65) Prior Publication Data

US 2024/0310101 A1 Sep. 19, 2024

(51) Int. Cl.

| | |
|---|---|
| ***F25C 1/08*** | (2006.01) |
| ***F25C 5/08*** | (2006.01) |
| ***F25C 5/187*** | (2018.01) |

(52) U.S. Cl.

CPC ..... *F25C 1/08* (2013.01); *F25C 5/08* (2013.01); *F25C 5/187* (2013.01)

(58) Field of Classification Search

CPC .... F25C 1/08; F25C 5/08; F25C 5/187; F25C 2600/02; F25C 2600/04; F25C 2700/12; F25C 2700/121; F25D 21/08

See application file for complete search history.

(56) References Cited

U.S. PATENT DOCUMENTS

| | | | | |
|---|---|---|---|---|
| 10,948,226 | B2 | 3/2021 | Bertolini et al. | |
| 11,079,152 | B2 | 8/2021 | Bertolini et al. | |
| 11,421,927 | B2 | 8/2022 | Mitchell | |
| 2009/0308085 | A1 | 12/2009 | DeVos | |
| 2016/0161167 | A1 | 6/2016 | Junge et al. | |
| 2016/0370096 | A1* | 12/2016 | Yang | F25C 5/22 |
| 2018/0142934 | A1* | 5/2018 | Junge | F25D 17/065 |
| 2019/0360736 | A1 | 11/2019 | DePlessis et al. | |
| 2021/0325094 | A1 | 10/2021 | Lee et al. | |
| 2024/0310105 | A1* | 9/2024 | Ryu | F25C 5/10 |

FOREIGN PATENT DOCUMENTS

| | | | |
|---|---|---|---|
| CN | 114608258 | A | 6/2022 |

* cited by examiner

*Primary Examiner* — Marc E Norman

(74) *Attorney, Agent, or Firm* — Dority & Manning, P.A.

(57) ABSTRACT

An ice maker appliance includes an ice box. The ice maker appliance further includes a mold body and a frost collector positioned in the ice box. The ice maker appliance also includes a working fluid loop. The working fluid loop is in conductive thermal communication with the mold body and with the frost collector.

15 Claims, 9 Drawing Sheets

ICE MAKER APPLIANCE CONTROL METHODS

FIELD OF THE INVENTION

The present subject matter relates generally to ice maker appliances, and in particular to systems and methods for controlling such appliances.

BACKGROUND OF THE INVENTION

Certain refrigerator appliances include an ice maker. An ice maker appliance may also be a stand-alone appliance designed for use in commercial and/or residential settings. To produce ice, liquid water is directed to the ice maker and frozen. For example, certain ice makers include a mold body for receiving liquid water. In some systems, a working fluid is used to directly cool the mold body, e.g., by conductive heat transfer as opposed to cooling the air around the mold body, to form ice. After ice is formed in the mold body, it may be harvested from the mold body and stored within an ice bin or bucket within the refrigerator appliance.

Such direct cooling of the mold body provides more effective cooling of the mold body, e.g., as compared to indirect cooling via the air around the mold body. For example, this more effective cooling provides faster ice formation. The high cooling capacity of such systems, however, may also lead to frost formation and accumulation on the mold body. The mold body may be the coldest part in the ice box, thus leading to significant buildup of frost on and around the mold body, which may interfere with the operation of the ice maker.

Accordingly, an ice maker with features for effectively cooling the mold body while also managing, e.g., preventing or reducing, frost accumulation thereon would be desirable.

BRIEF DESCRIPTION OF THE INVENTION

Aspects and advantages of the invention will be set forth in part in the following description, or may be apparent from the description, or may be learned through practice of the invention.

According to an exemplary embodiment, a method of operating an ice maker appliance is provided. The method includes forming one or more ice pieces from a first volume of liquid water in a mold body of the ice maker appliance and harvesting the one or more ice pieces from the mold body after forming the one or more ice pieces in the mold body. The method also includes cooling an ice box of the ice maker appliance after harvesting the one or more ice pieces. The mold body is positioned in the ice box. The method further includes flowing a second volume of liquid water into the mold body after cooling the ice box.

According to another exemplary embodiment, a method of operating an ice maker appliance is provided. The method includes determining that an ice storage bin of the ice maker appliance is full and initiating an ice storage mode in response to determining that the ice storage bin is full. The method also includes determining, during the ice storage mode, to defrost the ice maker appliance. The method further includes activating, during the ice storage mode, a heater of the ice maker appliance in response to determining to defrost the ice maker appliance.

According to a further exemplary embodiment, a method of operating an ice maker appliance is provided. The method includes determining that an ice storage bin of the ice maker appliance is full and initiating an ice storage mode in response to determining that the ice storage bin is full. The method also includes activating, during the ice storage mode, a defrost heater of the frost collector in response to a first condition. The method further includes activating, during the ice storage mode, a harvest heater in response to a second condition.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
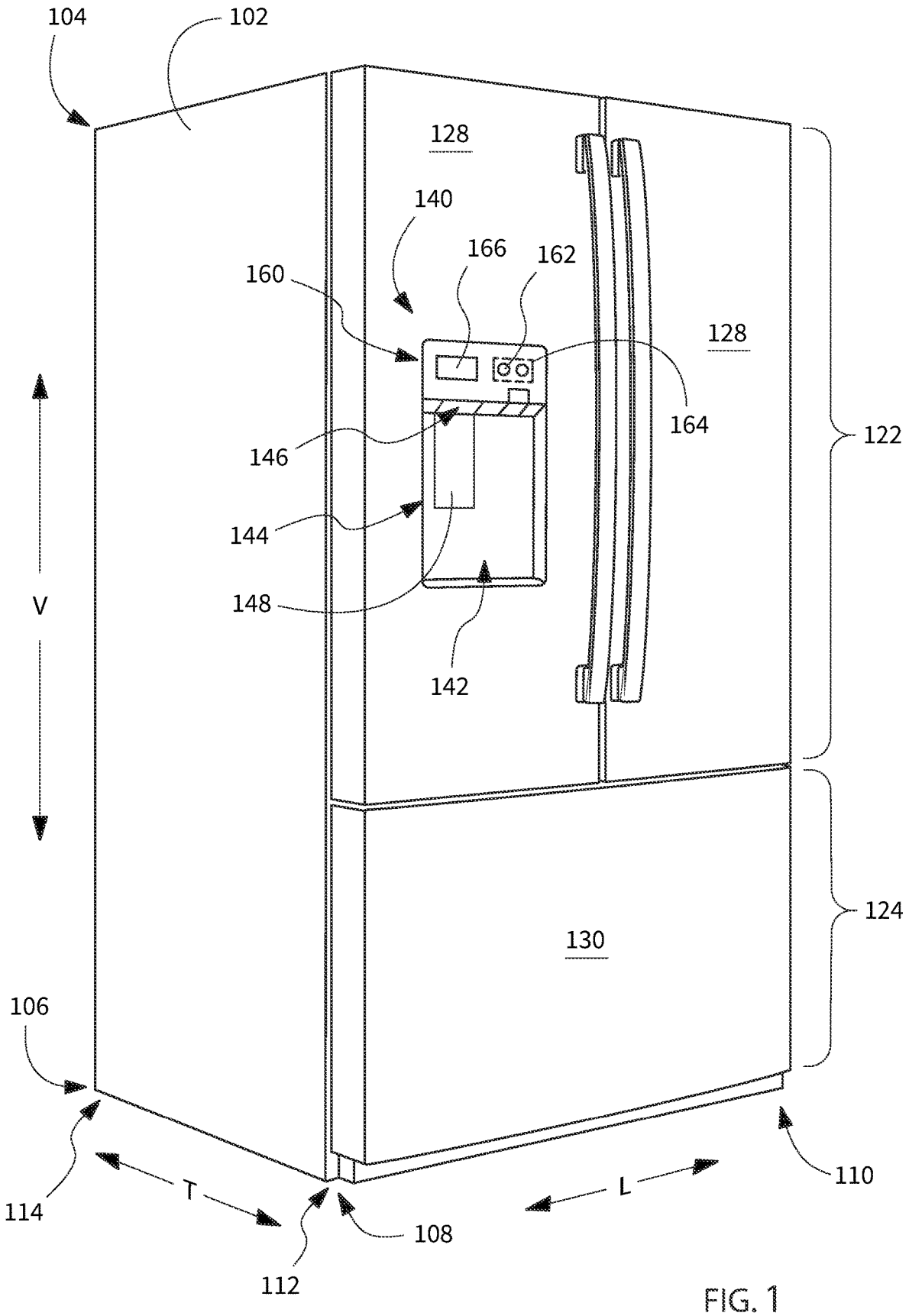
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "first," "second," and "third" may be used interchangeably to distinguish one component from another and are not intended to signify location or importance of the individual components.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
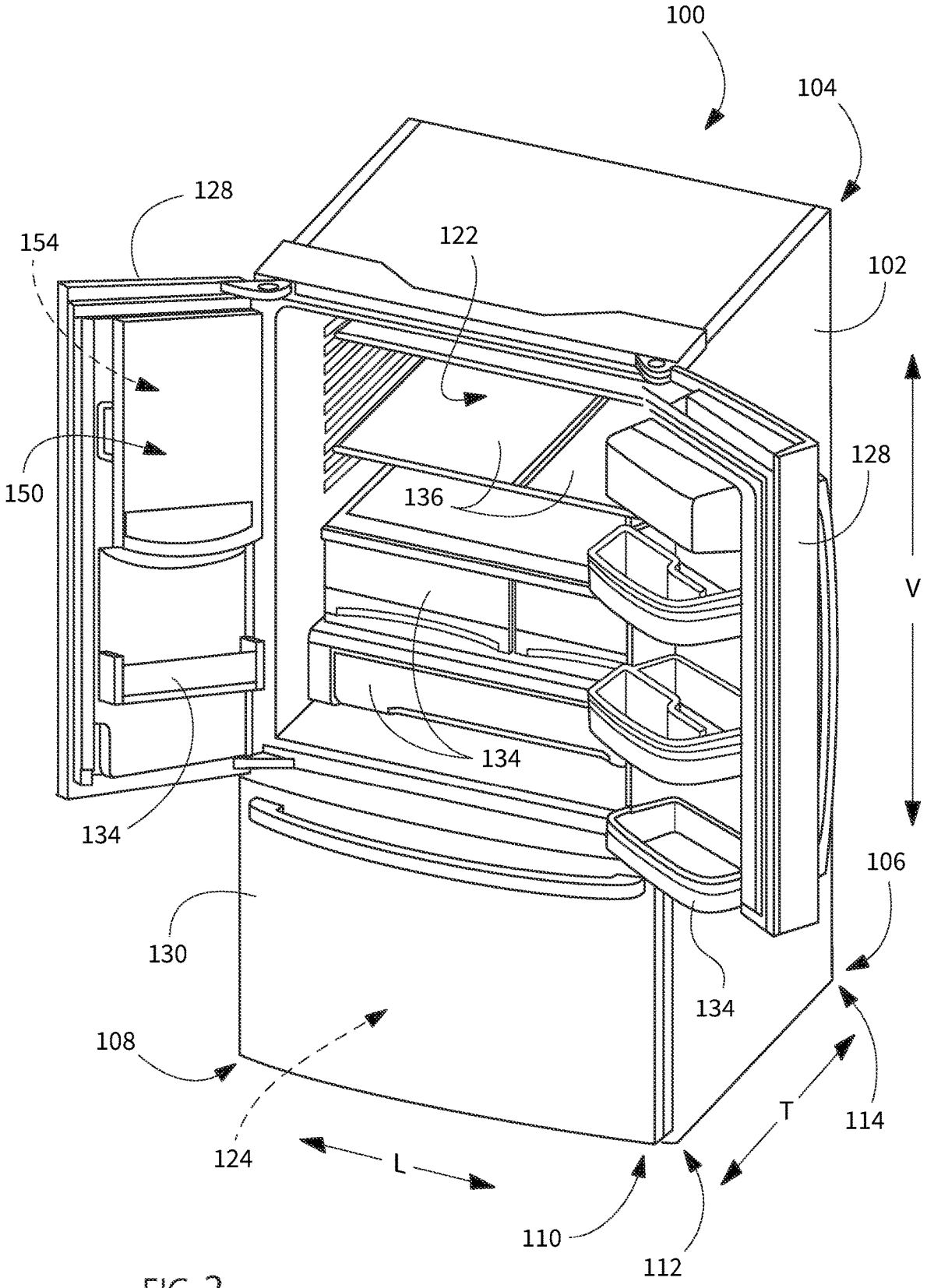
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

By contrast, inside refrigerator appliance 100, refrigerator door 128 may define an icebox 150 (FIGS. 2 through 4) housing an ice making assembly which includes a mold body 200 and an ice storage bin 202 that are configured to supply ice to dispenser recess 142. In this regard, for example, icebox 150 may define an ice making chamber 154 for housing an ice making assembly, a storage mechanism, and a dispensing mechanism.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations.

Figure 3:
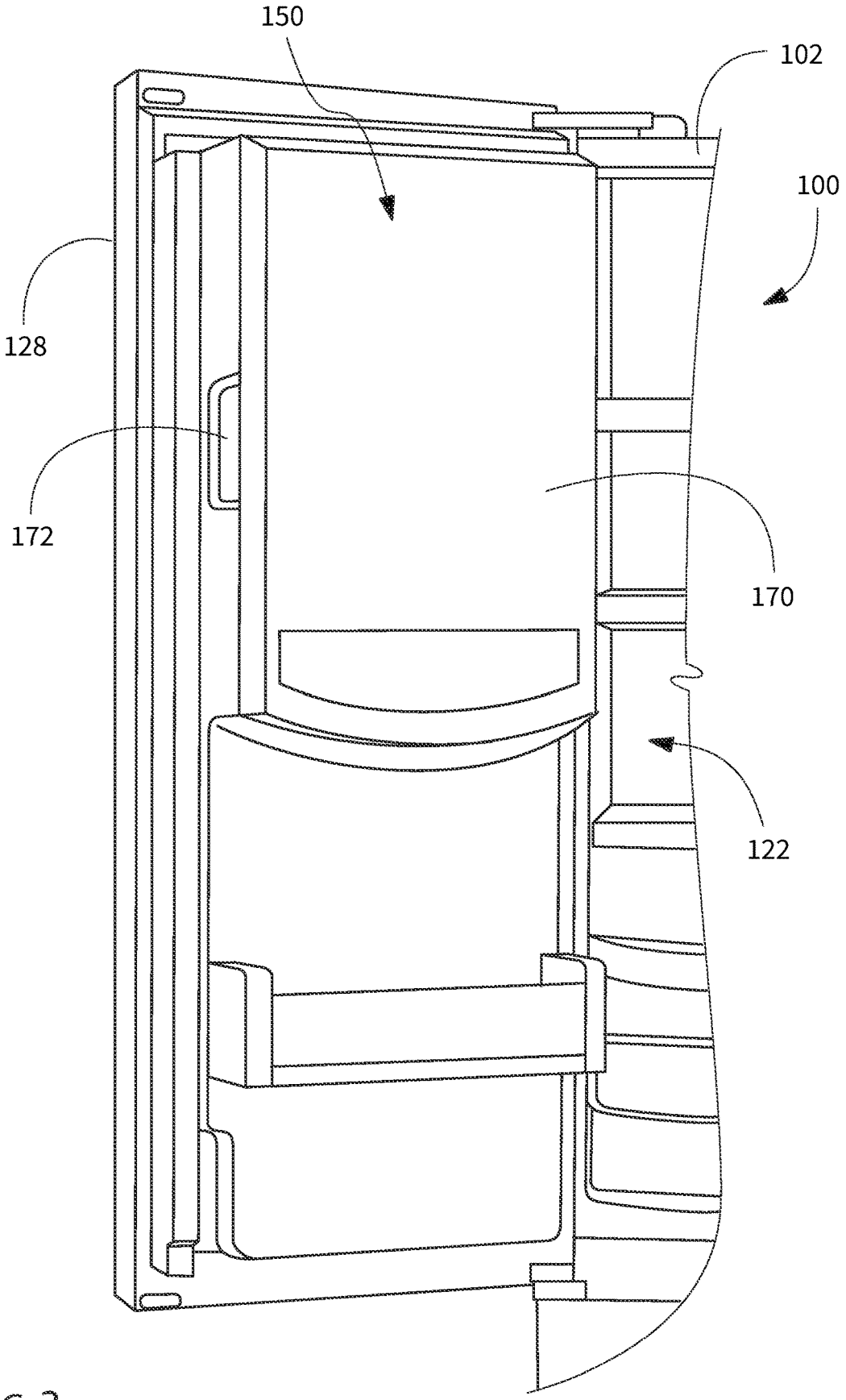
FIG. 3 provides an interior perspective view of a dispenser door of the exemplary refrigerator appliance of FIG. 1.
Figure 4:
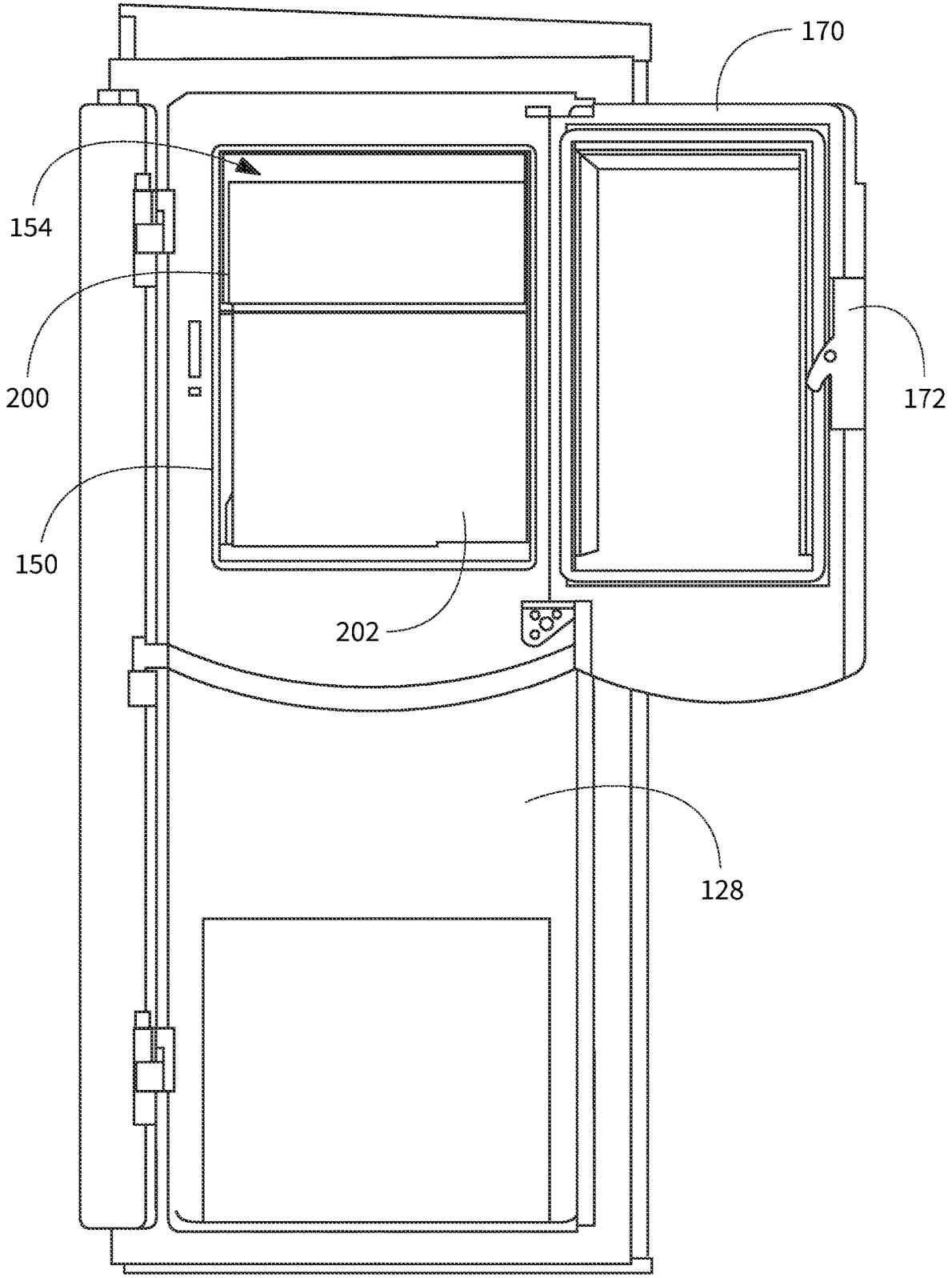
FIG. 4 provides an interior elevation view of the door of FIG. 3 with an access door of the door shown in an open position.

Referring now to FIGS. 3 and 4, FIG. 3 provides an interior perspective view of one of the refrigerator doors 128 and FIG. 4 provides an interior elevation view of the door 128 with an access door 170 shown in an open position. Refrigerator appliance 100 includes a sub-compartment 150 defined on refrigerator door 128. As mentioned above, the sub-compartment 150 may be referred to as an "icebox." In the illustrated exemplary embodiment, icebox 150 extends into fresh food chamber 122 when refrigerator door 128 is in the closed position. As shown in FIG. 4, the mold body 200 may be positioned within the icebox 150. The mold body 200 is generally configured for freezing the water to form ice, e.g., ice pieces such as ice cubes, which may be stored in storage bin 202 and dispensed through discharging outlet 146 by dispensing assembly 140. For example, the mold body 200 may include one or more mold cavities defined therein, and liquid water may be directed into the mold cavity or cavities of the mold body 200 and the water may then be retained therein at a temperature at or below the freezing point of water to form an ice piece or ice pieces. FIG. 4 illustrates the mold body 200 with an ice storage bin 202 positioned below the mold body 200 for receiving ice pieces from the mold body 200, e.g., for receiving the ice after the ice is ejected from the mold body 200. As those of ordinary skill in the art will recognize, ice from the mold body 200 is collected and stored in the ice storage bin 202 and supplied to dispenser 144 (FIG. 1) from the ice storage bin 202 in icebox 150 on a back side of refrigerator door 128. Chilled air from a sealed system (not shown) of refrigerator appliance 100 may be directed into or onto components within the icebox 150, e.g., mold body 200 and/or ice storage bin 202.

As mentioned above, the present disclosure may also be applied to other types and styles of refrigerator appliances such as, e.g., a top mount refrigerator appliance, a side-by-side style refrigerator appliance or a standalone ice maker appliance. Variations and modifications may be made to ice making assembly while remaining within the scope of the present subject matter. Accordingly, the description herein of the icebox 150 on the door 128 of the fresh food chamber 122 is by way of example only. In other example embodiments, the ice making assembly may be positioned in the freezer chamber 124, e.g., of the illustrated bottom-mount refrigerator, of a side by side refrigerator, of a top-mount refrigerator, or any other suitable refrigerator appliance. As another example, the ice making assembly may also be provided in a standalone ice maker appliance. As used herein, the term "standalone ice maker appliance" refers to an appliance of which the sole or primary operation is generating or producing ice, e.g., without any additional or other chilled chambers other than the icebox, whereas the more general term "ice maker appliance" includes such appliances as well as appliances with diverse capabilities in addition to making ice, such as a refrigerator appliance equipped with an ice maker, among other possible examples.

As mentioned above, an access door 170 may be hinged to the inside of the refrigerator door 128. Access door 170 permits selective access to icebox 150. Any manner of suitable latch 172 may be configured with icebox 150 to maintain access door 170 in a closed position. As an example, latch 172 may be actuated by a consumer in order to open access door 170 for providing access into icebox 150. Access door 170 can also assist with insulating icebox 150, e.g., by thermally isolating or insulating icebox 150 from fresh food chamber 122.

Figure 5:
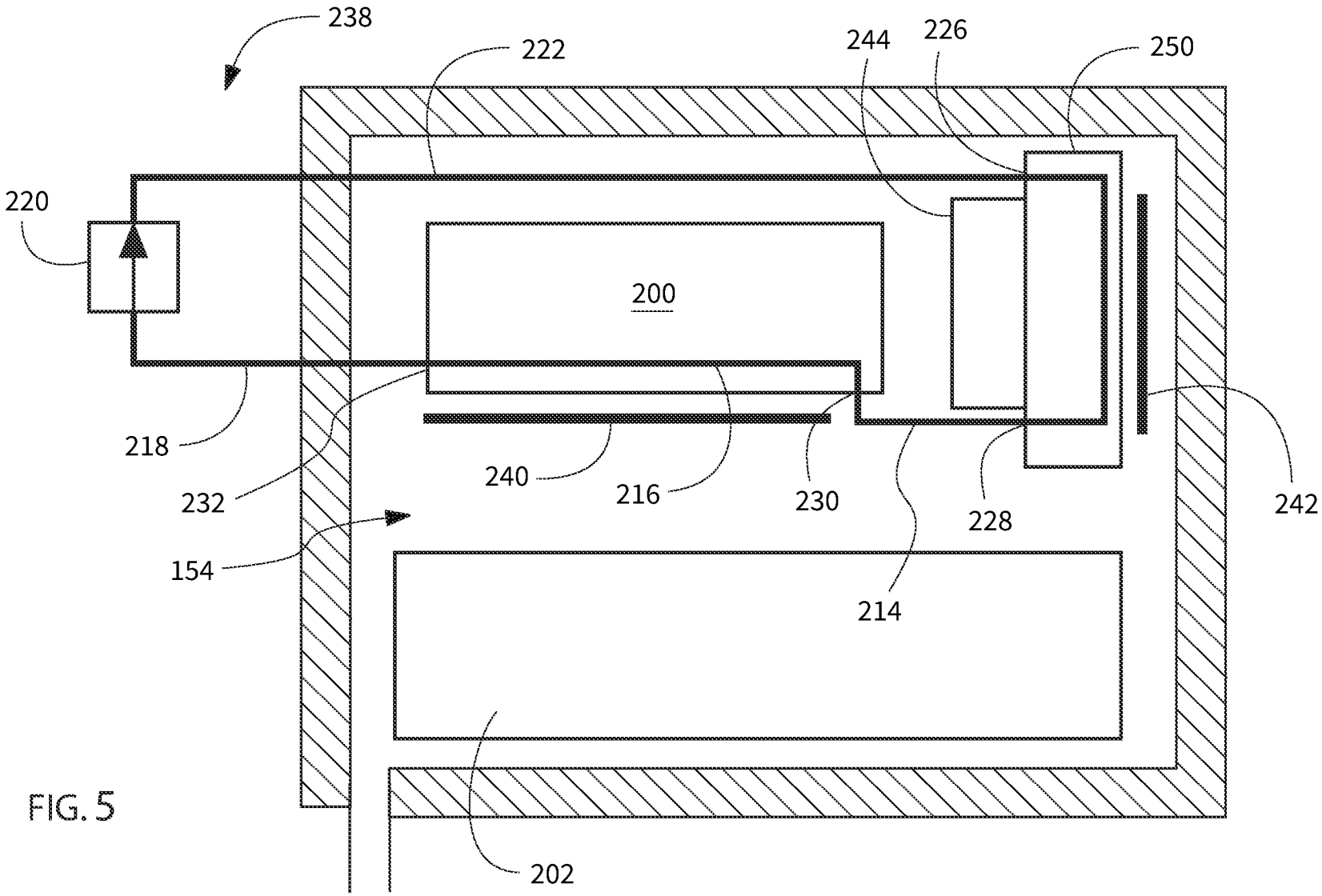
FIG. 5 provides a schematic illustration of an exemplary ice maker in accordance with one or more embodiments of the present disclosure.

As illustrated in FIG. 5, the ice making assembly employs a direct cooling system, e.g., whereby the mold body 200 is cooled by conductive heat transfer to a working fluid loop 238 that is in direct physical contact with, e.g., touching, the mold body 200. The exemplary ice making assembly illustrated in FIG. 5 generally includes a mold body 200 with one or more mold cavities defined therein for receiving liquid water and retaining at least a portion of the liquid water as the liquid water freezes to form ice, e.g., as described above. A working fluid may be circulated through the sealed working fluid loop 238 (comprising lines 214, 218, and 222), as further described below. The working fluid may be a refrigerant or coolant or other similar fluid. For example, the working fluid may be propane, isobutane, ammonia, ethylene glycol, propylene glycol, or other similar fluid, including combinations thereof. The working fluid may be provided in any suitable concentration, such as a mixture of any of the foregoing example fluids with water. A portion 216 of the working fluid loop 238 may be connected to or be situated in close proximity to a mold body 200 of ice making assembly, thereby effecting a direct (conductive) transfer of heat from mold body 200 to the sealed working fluid loop and/or the working fluid in the sealed working fluid loop, e.g., thereby chilling the mold body 200 such that liquid water in the mold body 200 freezes to form ice.

As mentioned, the mold body 200 may be directly, e.g., conductively, cooled by the working fluid loop 238. Thus, for example, the mold body 200 may be in contact with the working fluid loop 238, such as with a portion 216 of the working fluid loop 238, e.g., a portion of a connecting line 214 thereof which is downstream of a frost collector 250. In some embodiments, the mold body 200 may be in direct contact with the portion 216 of the working fluid loop 238 without any intervening space or structures therebetween. For example, in some embodiments, the portion 216 of the working fluid loop 238 may extend through and within a portion of the mold body 200, such as the portion 216 may be fully embedded within the mold body 200 whereby the portion 216 is surrounded by the mold body in all directions, or the portion 216 may be partially embedded within the mold body 200, e.g., the portion 216 may be received within a groove or recess formed in a side of the mold body 200, or the portion 216 may be outside of the mold body 200 and in direct contact with an external surface of the mold body 200.

The sealed working fluid loop 238 may include a working fluid pump 220 that is operable to urge the working fluid therethrough. For example, activating the working fluid pump 220 may cause the working fluid to circulate through the sealed working fluid loop 238, such as at a flow rate proportional to the operating speed of the working fluid pump 220. The working fluid pump 220 may supply the working fluid to a pressure line 222, which is connected to, e.g., coupled directly to, a first inlet 226 at a frost collector 250, which may be, e.g., a heat exchanger or a plate, as will be described in more detail below. The working fluid in the sealed working fluid loop 238 may travel through the frost collector from the first inlet 226 to a first outlet 228, e.g., the sealed working fluid loop 238 may include a portion which is fully or partially embedded in the frost collector 250 (such as fully embedded, e.g., as illustrated in FIG. 5), or which is outside of the frost collector 250 and in direct contact with an external surface of the frost collector, in a similar manner as described above with respect to the mold body 200. A connecting line 214 extends from the frost collector to the mold body 200, where a portion 216 of the working fluid loop 238 may be connected to the mold body 200 as described above. For example, in the embodiment illustrated in FIG. 5, the portion 216 may enter the mold body 200 at an inlet 230 of the mold body 200 and the portion 216 may extend to an outlet 232 of the mold body 200, where the working fluid loop 238 exits the mold body 200. Thus, the working fluid draws heat from the mold body 200, e.g., chills the mold body 200 such that liquid water in the one or more mold cavities of the mold body 200 may form ice, as the working fluid flows through the portion 216 of the working fluid loop 238.

From the mold body 200, e.g., downstream of the portion 216 in contact with the mold body 200, the working fluid in the sealed working fluid loop 238 returns to the working fluid pump 220 via a suction line 218.

In some embodiments, e.g., as illustrated in FIG. 5, the working fluid loop 238 may include one or more inlets, e.g., a first inlet 226 at the frost collector 250 and a second inlet 230 at the mold body 200, and a corresponding number of outlets, e.g., a first outlet 228 from the frost collector 250 and a second outlet 232 from the mold body 200.

The frost collector 250 may be upstream of the mold body 200 along the working fluid loop 238, e.g., the working fluid flowing through the working fluid loop 238 may first travel to the frost collector 250, whereupon the frost collector 250 is cooled and the working fluid in the working fluid loop 238 is warmed, and then the working fluid in the working fluid loop 238 may travel to the mold body 200, such that the working fluid is warmer when the working fluid reaches the mold body 200 than when the working fluid reaches the frost collector 250. Thus, the frost collector 250 may be colder than the mold body 200, such that any frost that does form in the icebox 150 will preferentially form at and on the frost collector 250 more than the mold body 200. Accordingly, the accumulation of frost, if any, which may occur within the icebox 150 is less likely to impede operations of the ice making assembly because the frost will form on the frost collector 250 rather than the mold body 200, e.g., will form on the frost collector 250 before or to a greater extent than the mold body 200.

The frost collector 250 generally comprises a material having a high thermal conductivity, such as a metal material, such as aluminum, zinc, copper, and/or other similar metal materials including alloys thereof. The frost collector 250 may be spaced apart from the mold body 200, such as by at least a distance sufficient to prevent or minimize accumulated frost bridging the space between the frost collector 250 and the bold body 200. As mentioned, the frost collector 250 may be a plate or may be a heat exchanger. For example, in embodiments where the frost collector 250 is a plate, the frost collector 250 may comprise a generally rectangular prism shape with each side of the frost collector 250 being generally flat. As another example, in embodiments where the frost collector 250 is a heat exchanger, the frost collector 250 may include a plurality of fins formed on at least one side of the frost collector 250 to provide increased surface area to volume of the frost collector 250, thereby increasing the rate of thermal transfer between the frost collector 250 and the air within the icebox 150. The structure and function of heat exchangers, such as fins thereof, are well understood by those of ordinary skill in the art and, as such, are not specifically illustrated or described in further detail herein for the sake of brevity and clarity. In some embodiments, a fan 224 may be included in close proximity to, such as in contact with, the frost collector 250. While the fan 224 may not necessarily be in contact with the frost collector 250, the fan 244 is positioned at least close enough to the frost collector 250 that, when the fan 244 is activated, the fan 244 may urge a flow of air across and/or around the frost collector 250. For example, in embodiments where the frost collector 250 is provided as a heat exchanger including fins, the fan 244 may urge the flow of air between, around, through, and/or across the fins of the frost collector 250. Such air flow urged by the fan 244 may be useful to decrease, e.g., cool down, the ambient temperature within the icebox 150.

The ice making assembly may further include a harvest heater 240 attached to or otherwise in close proximity to the mold body 200, such that the harvest heater 240 is operable to raise a temperature of the mold body 200 to promote the release of ice pieces from within the cavity or cavities, as is understood by those of skill in the art. The ice making assembly may also include a defrost heater 242 attached to or otherwise in close proximity to the frost collector 250 such that the defrost heater 242 is thermal communication with the frost collector. For example, the frost collector 250 may have a carrying capacity or carrying limit as to how much frost may be formed thereon, after which additional frost which forms in the icebox 150 (e.g., within the chamber 154 therein) may accumulate on other surfaces than the frost collector 250. Thus, the defrost heater 242 may be operable to remove frost from the frost collector when the defrost heater 242 is activated, and periodically removing such frost may restore the capacity of the frost collector 250 to carry or accumulate frost thereon, e.g., preferentially to other components of the ice making assembly such as the mold body 200.

Figure 6:
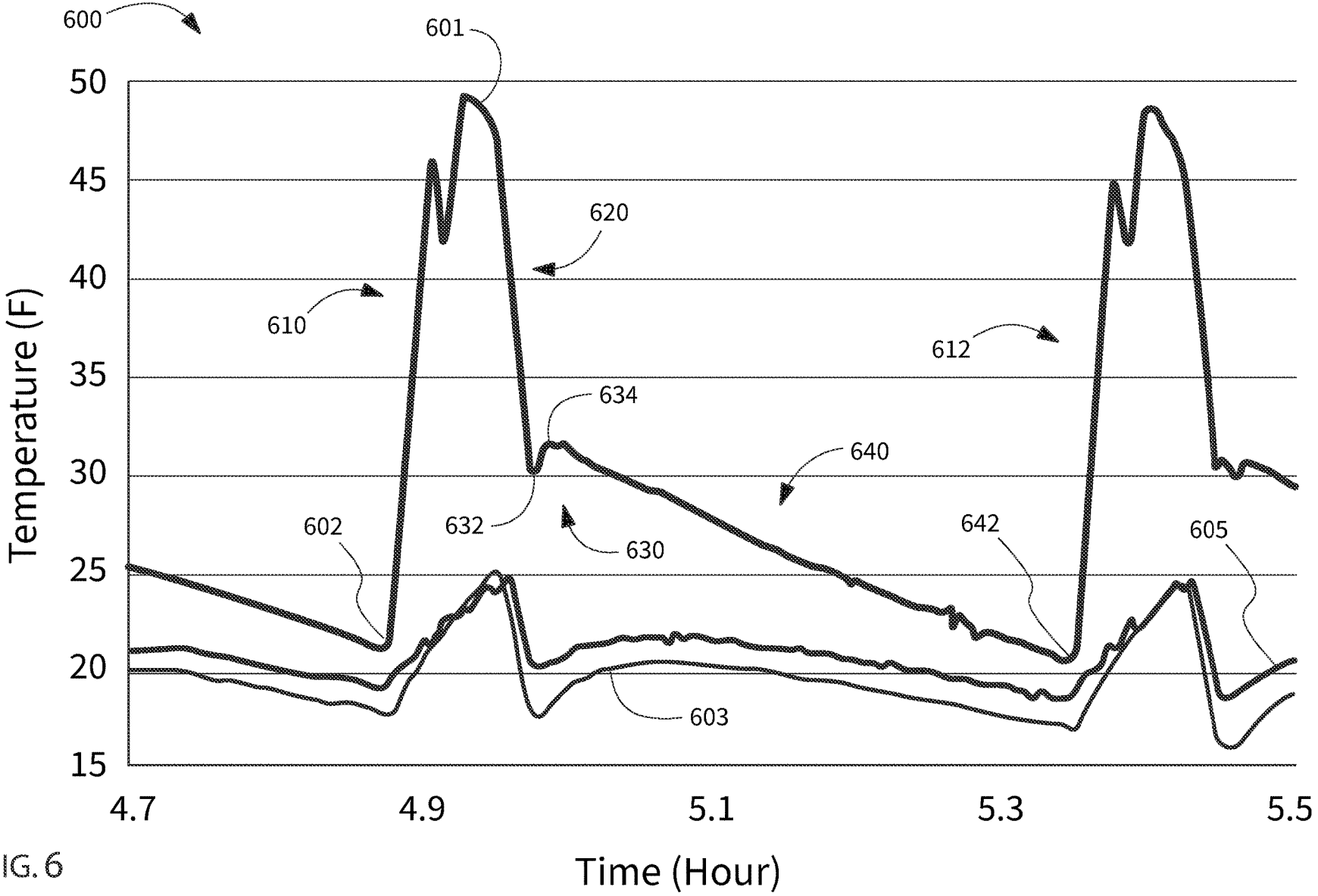
FIG. 6 provides an exemplary graph of temperatures of an ice maker appliance over time.

Turning now to FIG. 6, an exemplary graph 600 of various temperatures over time in an ice maker appliance is provided. In particular, graph 600 represents an exemplary mold body temperature 601, an exemplary frost collector temperature 603, and an exemplary ambient temperature 605, which is the ambient (air) temperature within an ice box of the ice maker appliance. Various operational stages or modes of the ice maker appliance may be initiated and/or terminated in response to one or more of the temperatures within the ice box of the ice maker appliance, such as the frost collector temperature or the ambient temperature. In the exemplary embodiment illustrated in FIG. 6, the modes are responsive to mold body temperature 601. As illustrated in FIG. 6, a harvest 610 begins when the mold body temperature 601 reaches a setpoint 602. During the harvest 610, a harvest heater (e.g., harvest heater 240) of the ice maker appliance may be activated, for example as indicated by the increase in mold body temperature 601 during the harvest 610. The harvest 610 may be followed by a cooling mode 620, e.g., wherein the mold body is cooled. For example, the cooling mode 620 may be immediately after the harvest 610, such as before filling the mold body with a subsequent volume of water. For example, the cooling mode 620 may be performed while the mold body is empty, e.g., generally or substantially empty of liquid water ("generally empty" is used herein to include up to ten percent of the volume of the mold cavities in the mold body having water therein, e.g., which may be remnants after the harvest 610, but is less than would be present after a water fill).

As illustrated in FIG. 6, the cooling mode 620 may be before a water fill 630, or the water fill 630 may be performed after the mold body has been cooled to a temperature less than the temperature of the mold body at the end of the harvest 610. Accordingly, the ice maker appliance may form ice from the liquid water more quickly by cooling the mold body separately prior to the fill 630, e.g., where the substantially empty mold body has a lesser thermal mass than the mold body filled with liquid water. The water fill 630 may begin when the mold body temperature 601 is cooled to a temperature 632. Where the liquid water is warmer than the mold body, mold body temperature 601 may increase during the water fill 630. For example, as may be seen in FIG. 6, the warmer water during the water fill 630 raises the mold body temperature 601 from temperature 632 at the end of the cooling mode to temperature 634 when the mold body is substantially full (e.g., when a volume of the mold body, such as a volume of the one or more mold cavities defined therein, is at least 90% occupied by liquid water) at the end of the water fill 630.

Still referring to FIG. 6, the water fill 630 may be followed by ice making 640. The mold body temperature 601 is greater than the ambient temperature 605 after the water fill 630. Thus, the mold body temperature 601 decreases during the ice making 640, e.g., as a result of convective heat transfer from the mold body to the ambient air within the ice box and/or conductive heat transfer such as direct cooling of the mold body via a working fluid loop. For example, in some embodiments, cooling of the mold body by ambient air within the ice box may be promoted by activating a fan, e.g., fan 244, to direct a flow of air to or towards the mold body, such as a fan in communication with a frost collector and particularly when the frost collector is or includes a heat exchanger, e.g., with fins thereon as discussed above. When the mold body temperature 601 reaches a setpoint temperature at 642, the ice making 640 ends and a next harvest 612 begins.

Figure 7:
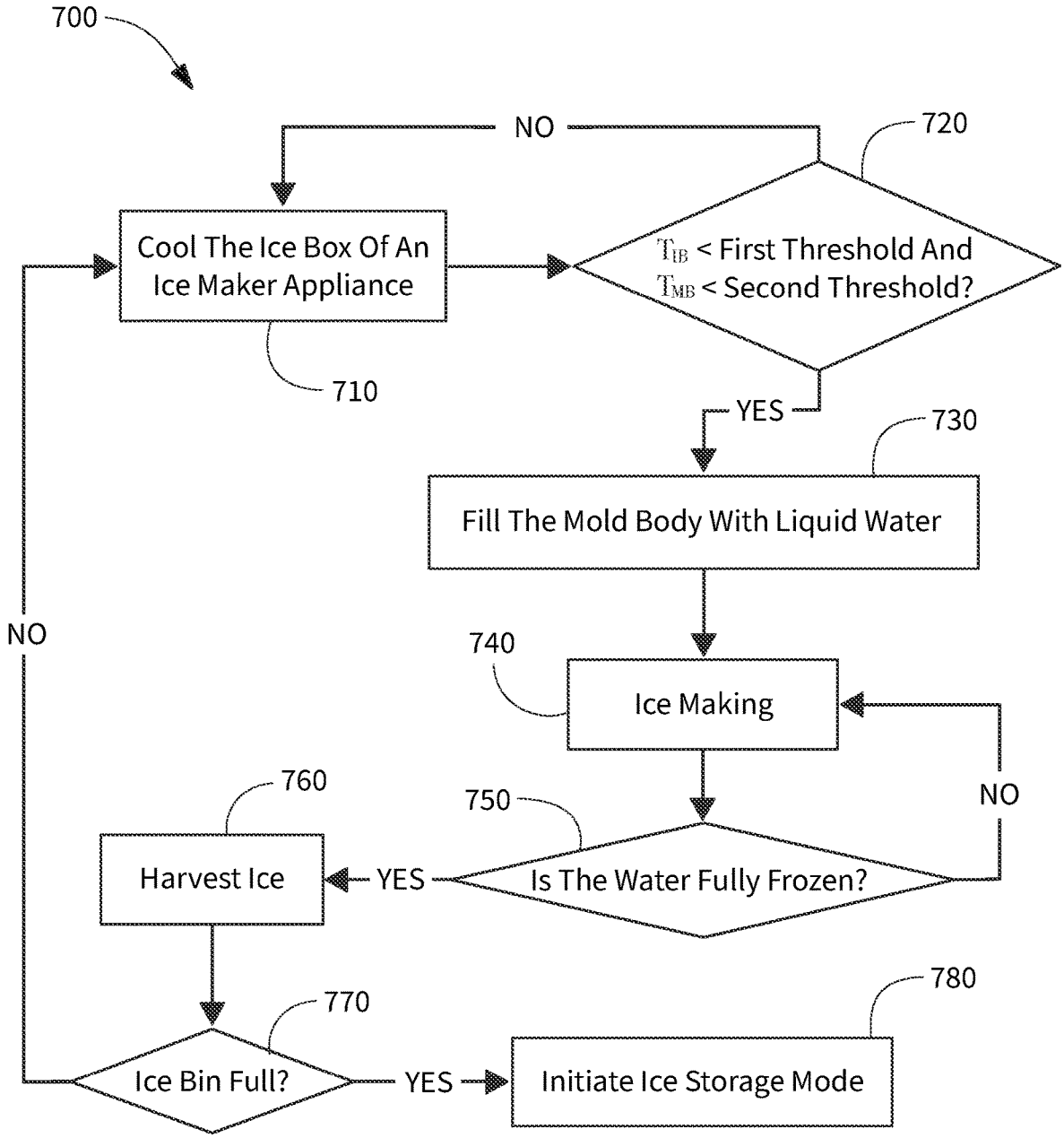
FIG. 7 provides an exemplary flow chart of a method of operating an ice maker appliance according to one or more exemplary embodiments of the present disclosure.

Turning now to FIG. 7, embodiments of the present disclosure also include methods of operating an ice maker appliance, such as the exemplary method 700 illustrated in FIG. 7. For example, the method 700 may be an ice making mode of the ice maker appliance, such as the method 700 may be a part of the ice making mode and/or the ice making mode may be a portion of the method 700. As illustrated in FIG. 7, the method 700 may include a step 710 of cooling the ice box of the ice maker appliance. In some embodiments, a mold body of the ice maker appliance may be directly cooled, such as cooling the ice box may include activating a working fluid pump to circulate a working fluid through a working fluid loop, where the working fluid loop extends at least partially within the ice box (such as in contact with the mold body within the ice box), and, as a result of such circulation, thermal energy is transferred from within the ice box to the working fluid, thereby cooling the ice box and components therein such as the mold body.

The method 700 may include a step 720 of monitoring one or more temperatures within the ice maker appliance, such as within an ice box of the ice maker appliance. For example, such temperatures may include an ambient temperature within the ice box, $T_{IB}$, and/or a temperature $T_{MB}$ of the mold body of the ice maker appliances. When one or more, such as both or all, of the monitored temperatures are below a threshold, a water fill may be initiated. For example, as indicated at 720 in FIG. 7, method 700 may include determining whether $T_{IB}$ and $T_{MB}$ are each less than a respective threshold, such as determining whether $T_{IB}$ is less than a first threshold and $T_{MB}$ is less than a second threshold. When at least one of the temperatures is not less than the respective threshold, the method 700 returns to step 710 and continues cooling. When both temperatures are each below the respective threshold, the method 700 may continue to a water fill, e.g., filling the mold body, e.g., one or more mold cavities defined therein, with liquid water as illustrated at 730 in FIG. 7.

After the water fill of step 730, the method 700 may continue to an ice making step, e.g., as indicated at step 740 in FIG. 7, where a volume of liquid water is directed to the mold body and the liquid (or at least partially liquid) water may be retained within the mold body during the ice making step, e.g., until the water is fully frozen. As illustrated in FIG. 7, the ice making step 740 may continue until the water is fully frozen, e.g., based on determination 750. When the water is fully frozen, e.g., in response to a positive determination 750, the method 700 may then harvest the ice from the mold body, e.g., as indicated at step 760 in FIG. 7. In some embodiments, harvesting the one or more ice pieces from the mold body may include activating a heater of the ice maker appliance, e.g., a harvest heater proximate the mold body. As a result of activating the heater, a temperature of the mold body is increased to a harvest temperature. In such embodiments, cooling the ice box, e.g., at an initial instance of step 710 or when returning to step 710 after harvesting step 760, may include decreasing the temperature of the mold body to a fill temperature less than the harvest temperature. For example, the fill temperature may be less than the harvest temperature by at least about two degrees Fahrenheit (2° F.), such as the fill temperature may be less than the harvest temperature by about five degrees Fahrenheit (5° F.) or more, such as the fill temperature may be less than the harvest temperature by about ten degrees Fahrenheit (10° F.) or more, such as the fill temperature may be less than the harvest temperature by about fifteen degrees Fahrenheit (15° F.) or more. Also in such embodiments, the harvest temperature may be greater than the freezing point of water, and/or the fill temperature may be approximately equal to the freezing point of water, or the fill temperature may be equal to or less than the freezing point of water.

In some embodiments, the ice maker appliance may include a frost collector. In embodiments where a frost collector is provided in the ice maker appliance, a defrost heater for defrosting the frost collector may also provided. Thus, such embodiments may also include activating the defrost heater of the frost collector of the ice maker appliance. For example, the step of activating the defrost heater may be only performed during step 760 of harvesting the one or more ice pieces, such as activation of the harvest heater in ice making mode may be limited to during step 760 and may be optional in the harvest 760. Accordingly, the additional heat from activation of the defrost heater within the ice box is not present during cooling or ice formation of the ice making mode. The harvest heater may be activated during some instances of harvest 760 or may be activated during all instances of harvest 760.

After the harvest 760, method 700 may then determine whether an ice storage bin of the ice maker appliance is full, e.g., as indicated at 770 in FIG. 7. When the ice storage bin is not full, the method 700 returns to step 710, cooling the ice box (and components therein, such as the mold body) before re-filling the mold body with a subsequent volume of liquid water and forming another batch of ice pieces. Thus, as described above with reference to FIG. 6, the cooling step 710 may be performed immediately after the harvest 760, such as before filling the mold body with a subsequent volume of water, e.g., at a subsequent iteration of step 730. When the ice storage bin is full, the method 700 may then proceed to a step 780 of initiating an ice storage mode.

Figure 8:
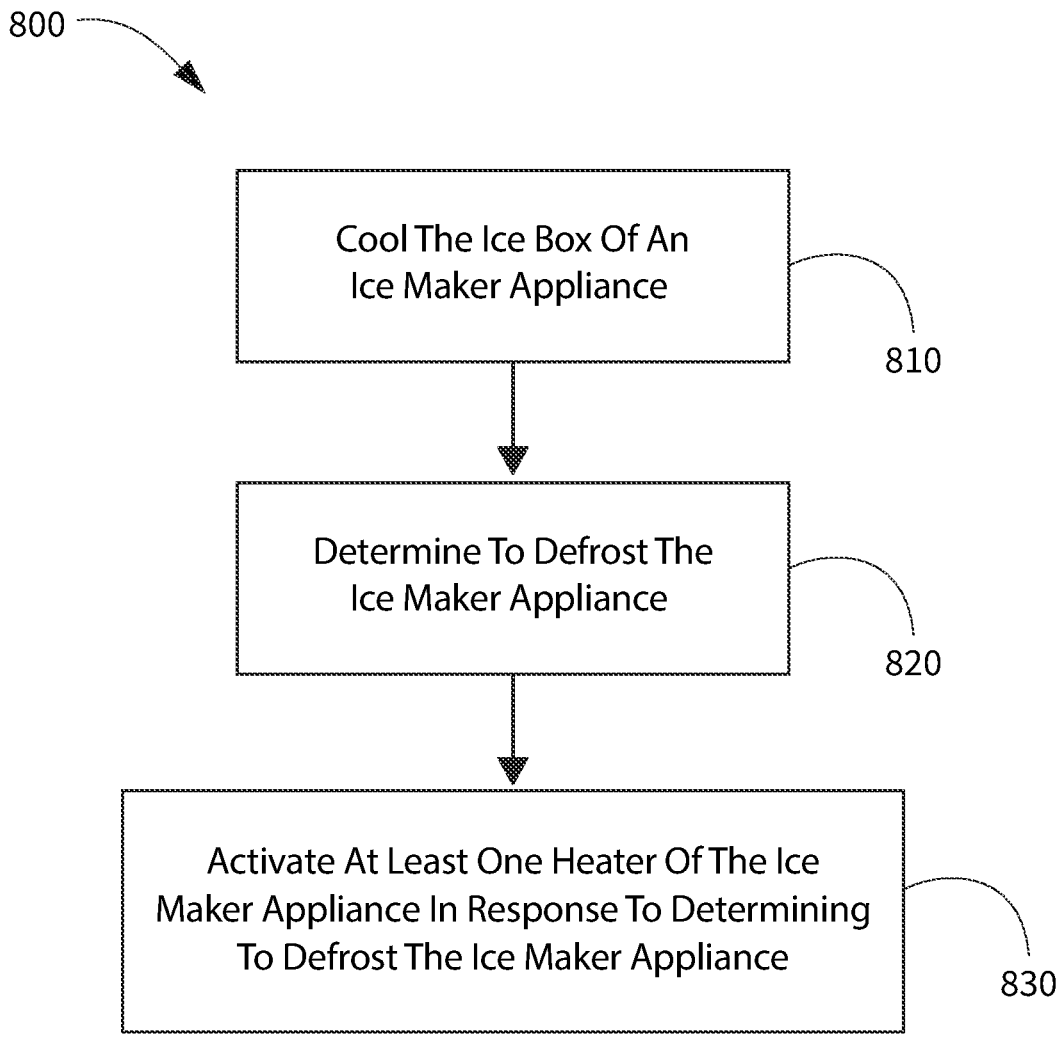
FIG. 8 provides another exemplary flow chart of a method of operating an ice maker appliance according to one or more additional exemplary embodiments of the present disclosure.
Figure 9:
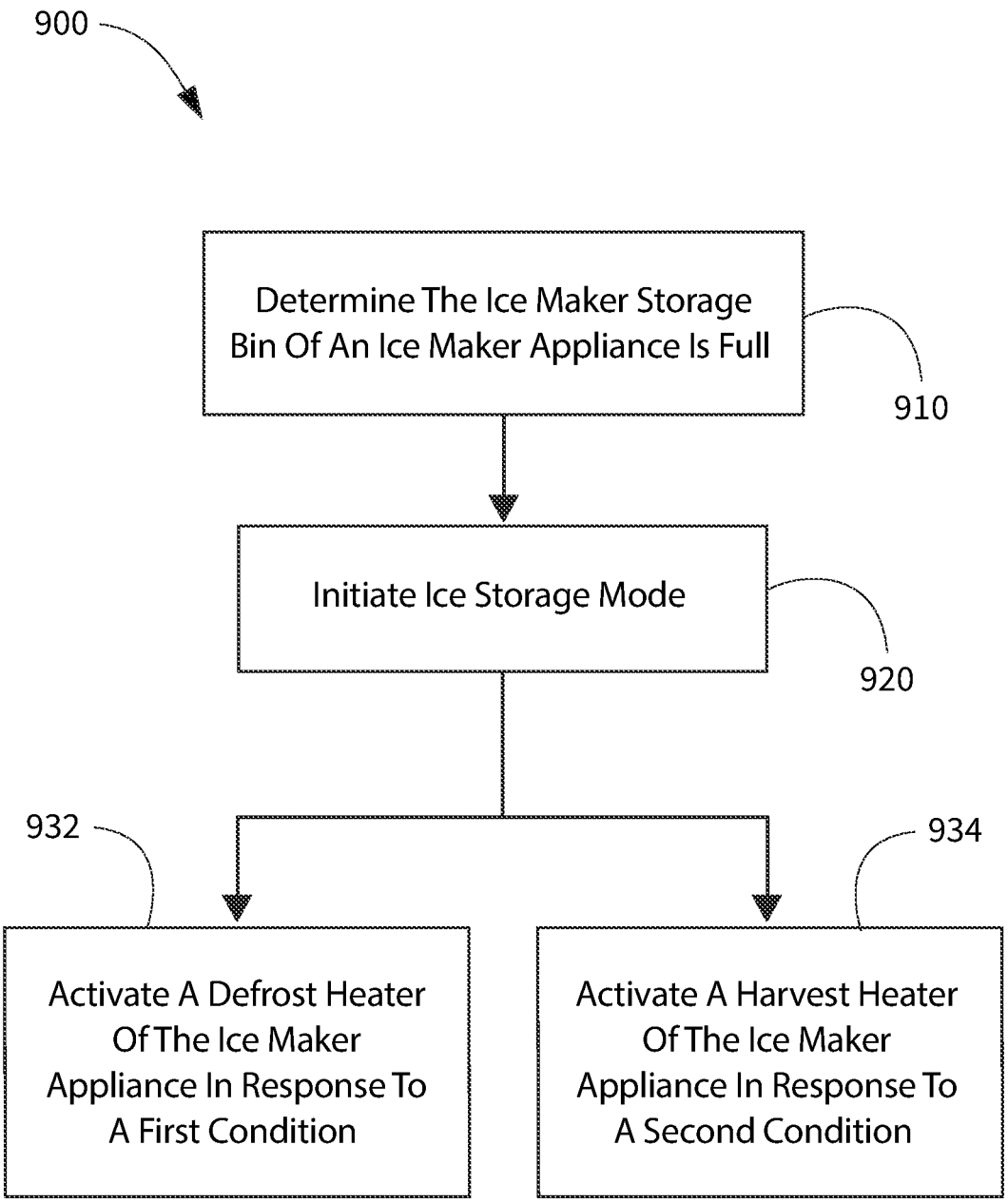
FIG. 9 provides a further exemplary flow chart of a method of operating an ice maker appliance according to one or more additional exemplary embodiments of the present disclosure.

Exemplary ice storage modes of an ice maker appliance according to embodiments of the present disclosure may include methods of operating the ice maker appliance such as the exemplary method 800 illustrated in FIG. 8 and/or the exemplary method 900 illustrated in FIG. 9.

An exemplary method 800 of operating an ice maker appliance is illustrated in FIG. 8, and method 800 may include or be a part of an ice storage mode of the ice maker appliance. For example, method 800 may include the ice storage mode and may also include one or more steps before or after the ice storage mode, such as determining that an ice storage bin of the ice maker appliance is full and initiating the ice storage mode in response to determining that the ice storage bin is full.

As illustrated in FIG. 8, the method 800 may include a step 810 of cooling an ice box of the ice maker appliance, such as by activating one or more of a working fluid pump or fan of the ice maker appliance. Step 810 may be part of, e.g., a first step of, the ice storage mode of the ice maker appliance.

Method 800 may further include a step 820 of determining to defrost the ice maker appliance. In some embodiments, step 820 may be performed during the ice storage mode. Determining to defrost the ice maker appliance may be based on one or more conditions.

For example, in some embodiments, determining to defrost the ice maker appliance may be based on a cooling time of the ice maker appliance, such as an elapsed time since the cooling step 810 was initiated. In such embodiments, determining to defrost the ice maker appliance may include comparing the cooling time to a predetermined time limit and determining to defrost the ice maker appliance in response to the cooling time greater than the predetermined time limit.

As another example, the condition on which determining to defrost the ice maker appliance is based may be or include a frost collector temperature. For example, in some embodiments, determining to defrost the ice maker appliance may be based on the frost collector temperature less than a predetermined frost collector temperature threshold.

In some embodiments, the determination to defrost the ice maker appliance may also or instead be based on a temperature difference. For example, determining to defrost the ice maker appliance may be based on a temperature difference between a temperature of the mold body of the ice maker appliance and a temperature of the frost collector of the ice maker appliance less than a predetermined temperature difference threshold, such as when the mold body temperature minus the frost collector temperature is less than the predetermined temperature difference threshold. As discussed above, the frost collector is generally colder than the mold body such that frost may preferentially form on the frost collector and away from the mold body, whereby the frost is less likely to impede the water fill, ice formation, or other operations of the ice maker appliance. When the mold body temperature is not greater than the frost collector temperature by at least the predetermined temperature difference threshold, the frost collector may be generally fully frosted over, such that defrosting the ice maker appliance, e.g., defrosting at least the frost collector thereof, may be desired.

In some embodiments, the determination to defrost the ice maker appliance may also or instead be based on how quickly or effectively the ice maker appliance, such as the mold body or ambient air within the ice box, is cooled. In such embodiments, exemplary methods according to the present disclosure such as method 800 may include monitoring one or more temperatures within the ice maker appliance, such as the mold body temperature, etc., during the ice storage mode, such as during the cooling step 810 which may be a part of the ice storage mode. Such embodiments may also include determining to defrost the ice maker appliance when (and based on) the one or more monitored temperatures do not reach a predetermined set point or points within a predetermined time limit. For example, method 800 may include comparing a cooling time to a predetermined time limit and determining to defrost the ice maker appliance in response to the cooling time greater than the predetermined time limit.

Referring again to FIG. 8 in particular, method 800 may also include a step 830 of activating, during the ice storage mode, a heater of the ice maker appliance in response to determining to defrost the ice maker appliance. The heater which is activated may be a harvest heater, e.g., proximate to the mold body, or a defrost heater, e.g., proximate to the frost collector. As used herein, each heater is "proximate" the respective mold body or frost collector when the heater is closer to the component than to any other components of the ice maker appliance, such as the harvest heater may be in contact with the mold body and/or may be closer to the mold body than to any other component of the ice maker appliance and, similarly, the defrost heater may be in contact with (touching) the frost collector and/or closer to the frost collector than to any other component of the ice maker appliance. Thus, in some embodiments, activating the heater of the ice maker appliance may include activating a defrost heater of a frost collector of the ice maker appliance and/or activating a harvest heater of the ice maker appliance.

In various embodiments, one or both of the harvest heater and the defrost heater may be activated during step 830, and, in embodiments where both are activated, the heaters may be activated successively or concurrently. For example, in some embodiments where both heaters are activated during a defrost cycle, the defrost heater of the frost collector may be activated first and the harvest heater of the mold body may be activated after the defrost heater, such as after the defrost heater is deactivated.

In some embodiments, methods according to the present disclosure such as method 800 may include incrementing a cycle count after determining to defrost the ice maker appliance. In such embodiments, activating the heater of the ice maker appliance may include activating the harvest heater of the ice maker appliance in response to the cycle count.

In some embodiments, initiating the ice storage mode may include activating a cooling system to cool the ice box of the ice maker appliance. The decision to defrost the ice maker appliance may be based on a cooling time, e.g., when the cooling is too slow or the cooling time is too long, which may be due to an accumulation of frost within the ice box. For example, in such embodiments, determining to defrost the ice maker appliance during the ice storage mode may include comparing a cooling time to a predetermined time limit and determining to defrost the ice maker appliance in response to the cooling time greater than the predetermined time limit. As another example, the slow or otherwise ineffective cooling may be detected based on temperature. For example, some embodiments may include monitoring a temperature within the ice box after activating the cooling system, such as one or more of mold body temperature, frost collector temperature, or ambient temperature. In such embodiments, determining to defrost the ice maker appliance may include determining that the monitored temperature within the ice box has not reached a cooling temperature threshold within a predetermined maximum cooling time.

In some embodiments, determining to defrost the ice maker appliance during the ice storage mode may include determining to defrost the ice maker appliance based on a temperature difference between a mold body of the ice maker appliance and a frost collector of the ice maker appliance less than a predetermined temperature difference threshold. For example, it is desired for the frost collector to be colder than the mold body, e.g., whereby frost will form on the frost collector preferentially to other components in the ice box, such as the mold body. For example, it may be desired for the frost collector to be colder than the mold body by at least a minimum amount, such as at least by the predetermined temperature difference threshold. The temperature difference between the mold body and the frost collector may be less than the predetermined temperature difference threshold when the frost collector is fully frosted or is at or near a frost carrying capacity, such that frost begins to accumulate on the mold body or to accumulate more quickly on the mold body. Thus, the temperature difference between the mold body of the ice maker appliance and the frost collector of the ice maker appliance less than the predetermined temperature difference threshold may indicate a need to defrost the ice maker appliance, e.g., to defrost at least the frost collector and thereby restore the frost carrying capacity of the frost collector.

Another exemplary method 900 of operating an ice maker appliance, which may be or include an ice storage mode or may be a part of an ice storage mode, is illustrated in FIG. 9. As illustrated in FIG. 9, the method 900 may include a step 910 of determining that an ice storage bin of the ice maker appliance is full and a step 920 of initiating the ice storage mode in response to determining that the ice storage bin is full.

During the ice storage mode, method 900 may include defrosting one or more components of the ice maker appliance. For example, in some embodiments, method 900 may include a step 932 activating a defrost heater of the frost collector in response to a first condition. Method 900 may also or instead include a step 934 of activating a harvest heater in response to a second condition.

In some embodiments, method 900 may further include incrementing a cycle count after activating the defrost heater and comparing the cycle count to a predetermined value. In such embodiments, the second condition may be or include the cycle count is a multiple of the predetermined value. For example, where the predetermined value (N) is two, the mold body may be defrosted by activating the harvest heater every other cycle. As another example, where N is three, the mold body may be defrosted every third cycle (e.g., when the cycle count equals three, six, nine, etc., for as long as the ice storage mode continues). Those of ordinary skill in the art will recognize that exemplary ice storage modes described herein throughout, e.g., in the context of methods 800 and/or 900, may end when the ice storage bin is no longer full.

In some embodiments, step 920 of initiating the ice storage mode may include activating a cooling system to cool an ice box of the ice maker appliance. In such embodiments, the first condition may be or include a cooling time since activating the cooling system greater than a predetermined time limit. Such embodiments may also include monitoring a temperature within the ice box after activating the cooling system, and the first condition may be or include the monitored temperature within the ice box has not reached a cooling temperature threshold within a predetermined maximum cooling time.

In some embodiments, the first condition may be or include a frost collector temperature less than a predetermined frost collector temperature threshold.

In some embodiments, the first condition may be or include a temperature difference between a mold body of the ice maker appliance and a frost collector of the ice maker appliance less than a predetermined temperature difference threshold.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an ice maker appliance, the method comprising:

determining that an ice storage bin of the ice maker appliance is full;

initiating an ice storage mode in response to determining that the ice storage bin is full;

determining, during the ice storage mode, to defrost the ice maker appliance based on a frost collector temperature less than a predetermined frost collector temperature threshold; and activating, during the ice storage mode, a heater of the ice maker appliance in response to determining to defrost the ice maker appliance.

2. The method of claim 1, wherein activating the heater of the ice maker appliance comprises activating a defrost heater of the frost collector of the ice maker appliance.

3. The method of claim 1, further comprising incrementing a cycle count after determining to defrost the ice maker appliance, and activating a harvest heater of the ice maker appliance in response to the cycle count.

4. The method of claim 1, wherein initiating the ice storage mode comprises activating a cooling system to cool an ice box of the ice maker appliance and wherein determining, during the ice storage mode, to defrost the ice maker appliance further comprises comparing a cooling time to a predetermined time limit and determining to defrost the ice maker appliance in response to the cooling time greater than the predetermined time limit, wherein activating the heater of the ice maker appliance comprises activating a defrost heater of the frost collector and activating a harvest heater of the ice maker appliance.

5. The method of claim 1, wherein initiating the ice storage mode comprises activating a cooling system to cool an ice box of the ice maker appliance and monitoring a temperature within the ice box after activating the cooling system, wherein determining, during the ice storage mode, to defrost the ice maker appliance further comprises determining that the monitored temperature within the ice box has not reached a cooling temperature threshold within a predetermined maximum cooling time, wherein activating the heater of the ice maker appliance comprises activating a defrost heater of the frost collector and activating a harvest heater of the ice maker appliance.

6. A method of operating an ice maker appliance, the method comprising:

determining that an ice storage bin of the ice maker appliance is full;

initiating an ice storage mode in response to determining that the ice storage bin is full;

activating, during the ice storage mode, a defrost heater of a frost collector of the ice maker appliance in response to a first condition; and activating, during the ice storage mode, a harvest heater in response to a second condition.

7. The method of claim 6, further comprising incrementing a cycle count after activating the defrost heater, and comparing the cycle count to a predetermined value, wherein the second condition comprises the cycle count is a multiple of the predetermined value.

8. The method of claim 6, wherein initiating the ice storage mode comprises activating a cooling system to cool an ice box of the ice maker appliance and wherein the first condition comprises a cooling time since activating the cooling system greater than a predetermined time limit.

9. The method of claim 6, wherein the first condition comprises a frost collector temperature less than a predetermined frost collector temperature threshold.

10. The method of claim 6, wherein the first condition comprises a temperature difference between a mold body of the ice maker appliance and a frost collector of the ice maker appliance less than a predetermined temperature difference threshold.

11. The method of claim 6, wherein initiating the ice storage mode comprises activating a cooling system to cool an ice box of the ice maker appliance and monitoring a temperature within the ice box after activating the cooling system, wherein the first condition comprises the monitored temperature within the ice box has not reached a cooling temperature threshold within a predetermined maximum cooling time.

12. A method of operating an ice maker appliance, the method comprising:

determining that an ice storage bin of the ice maker appliance is full;

initiating an ice storage mode in response to determining that the ice storage bin is full, wherein initiating the ice storage mode comprises activating a cooling system to cool an ice box of the ice maker appliance;

comparing a cooling time to a predetermined time limit;

determining, during the ice storage mode, to defrost the ice maker appliance in response to the cooling time greater than the predetermined time limit; and activating, during the ice storage mode, a heater of the ice maker appliance in response to determining to defrost the ice maker appliance.

13. The method of claim 12, further comprising incrementing a cycle count after determining to defrost the ice maker appliance, wherein activating the heater of the ice maker appliance comprises activating a harvest heater of the ice maker appliance in response to the cycle count.

14. The method of claim 12, wherein activating the heater of the ice maker appliance comprises activating a defrost heater of a frost collector of the ice maker appliance.

15. The method of claim 14, wherein the cooling time greater than the predetermined time limit comprises a first condition, further comprising activating, during the ice storage mode, a harvest heater of the ice maker appliance in response to a second condition.

* * * * *